US005400462A

United States Patent [19]

Amoretti

[11] Patent Number: 5,400,462

[45] Date of Patent: Mar. 28, 1995

[54] MULTI-PURPOSE APPLIANCE FOR HOUSEHOLD WORK

[75] Inventor: Luigi Amoretti, Fellette di Romano, Italy

[73] Assignee: T.P.A. Impex Italia S.r.l., Mussolente, Italy

[21] Appl. No.: 48,529

[22] Filed: Apr. 20, 1993

[30] Foreign Application Priority Data

Apr. 23, 1992 [IT] Italy ..... PD92A0076
Sep. 1, 1992 [IT] Italy ..... PD92A0154

[51] Int. Cl.[6] ..... A47L 7/04

[52] U.S. Cl. ..... 15/321; 15/322; 15/346; 15/353

[58] Field of Search ..... 15/320–322, 15/345

[56] References Cited

U.S. PATENT DOCUMENTS

| | | | |
|---|---|---|---|
| 2,571,575 | 10/1951 | Holmes | 15/321 |
| 3,262,146 | 7/1966 | Hays | 15/321 |
| 3,663,984 | 5/1972 | Anthony et al. . | |
| 3,733,176 | 5/1973 | Wisdom . | |
| 3,774,262 | 11/1973 | Anthony et al. . | |
| 3,854,163 | 12/1974 | Evans | 15/321 |
| 3,974,541 | 8/1976 | Silvis | 15/320 |
| 4,167,799 | 9/1979 | Webb | 15/320 |
| 4,216,563 | 8/1980 | Cyphert | 15/321 |
| 4,284,127 | 8/1981 | Collier | 15/321 |
| 4,287,635 | 9/1981 | Jacobs | 15/321 |
| 4,327,459 | 5/1982 | Gilbert . | |
| 4,367,565 | 1/1983 | Parise | 15/321 |
| 4,397,057 | 8/1983 | Harbeck . | |
| 4,443,909 | 4/1984 | Cameron | 15/320 |
| 5,224,237 | 7/1993 | Ambrosiano | 15/322 |

FOREIGN PATENT DOCUMENTS

| | | | |
|---|---|---|---|
| 0104345 | 4/1984 | European Pat. Off. . | |
| 0176697 | 4/1986 | European Pat. Off. . | |
| 2315896 | 1/1977 | France . | |
| 2621259 | 4/1989 | France | 15/321 |
| 8801146 | 2/1988 | WIPO . | |
| 8904729 | 6/1989 | WIPO . | |

*Primary Examiner*—Timothy F. Simone
*Assistant Examiner*—Terrence R. Till
*Attorney, Agent, or Firm*—Guido Modiano; Albert Josif

[57] ABSTRACT

Multi-purpose appliance for household work comprising, in combination in a wheeled body, steam generation elements, elements for generating a jet of air and aspiration elements. Couplings for dispensing and aspiration ducts are connected to the steam generation elements, to the means for generating a jet of air and to the aspiration elements.

22 Claims, 9 Drawing Sheets

133
134
132
131
130

136
204
135
26
143
139

154
142
26
140
143
139
204
137
130

131
132
144
142
154
26a
136
130
137
139
26

131
132
149
138
149
26a
144
150
153
152
147
146
151
205
141

200
169
170
165
166
167
164
163
165

200
169

170
171
163
168
164
167

XV
XV
134
176
172
177
174

174
172
173
XX
XX
177

XIX
XIX
199
176
173
172
174
177

MULTI-PURPOSE APPLIANCE FOR HOUSEHOLD WORK

BACKGROUND OF THE INVENTION

The present invention relates to a multi-purpose appliance for household work.

Combined appliances which have, in a single wheeled box-like body, steam generating and dispensing means and aspiration means, generally for solids and liquids, are already commercially available.

Although they constitute a technical improvement with respect to appliances for household work, such as separately provided aspirators and steam generators, as they have undisputed advantages and combine two functions in a single appliance with savings from the point of view of production and from the point of view of the user, these appliances are only partially able to meet the actual requirements of their users.

Apart from the above mentioned case of double combined steam-generating and aspirator appliance, a dedicated appliance for each specific function is currently commercially available for each household task.

This has caused houses to be invaded by a plurality of small household appliances which have subjected housewives to problems in use and to problems in bulk when these appliances are not used.

From the point of view of production, too, so far companies have had to organize themselves so as to manufacture single-use appliances, and this entails high investments as well as high facility management costs.

As also known, vacuum cleaners combined with steam generators for cleaning spaces in which there is particularly resistant dirt are available.

However, these vacuum cleaners have hardly negligible drawbacks.

These vacuum cleaners in fact usually have a single flexible duct connecting a container of the steam generator and of the aspirator to the distribution spout or handle.

The steam conveyance tube, the supplies of the distribution unit and the aspiration duct all pass within the single flexible duct.

One drawback which can be observed immediately is linked to the interaction between steam and the air at room temperature which is aspirated and is thus in forced aspiration conditions.

In fact, due to the well-known laws of thermodynamics, the steam transfers part of its heat to the forced-circulating air which surrounds its duct.

This causes the partial condensation of the steam, and therefore water drips onto the surface to be cleaned from the holes for distributing steam on said surface, and it is thus not possible to use the cleaning action of part of the steam.

Another drawback is constructive, since the unions for connection between the appliance and the connecting duct, as well as the duct itself, are particularly difficult and expensive to manufacture.

Furthermore, the electric contacts on the appliance must be protected, to avoid the deposition of steam or condensation on them in order to prevent their oxidation, which is the source of parasitic resistances which can negatively affect correct operation of the contacts and their possibility of providing appropriate contacts with the contacts provided on the connecting duct.

SUMMARY OF THE INVENTION

The aim of the present invention is to provide an appliance which can perform a plurality of tasks for uses in household work.

An important object is to provide a device for distributing gaseous and/or liquid fluids and for aspirating liquids, powders and solids particularly for cleaning in civil and industrial spaces which eliminates the problem of the dripping of water onto the surfaces to be cleaned.

A primary object is to provide users with an appliance which can replace the plurality of small household appliances used so far.

Another important object is to provide an appliance which can perform all of its functions in an optimum manner.

Another object is to provide an appliance having undisputed advantages from the point of view of production and of the necessary investments, with respect to the plurality of appliances which it replaces.

Another object is to provide a distribution device which allows simple execution and protection of the electric contacts.

Another object of the present invention is to provide a distribution device which is highly reliable and relatively easy to manufacture.

Another object is to provide an appliance which can be manufactured with conventional equipment and facilities and can be marketed at a competitive price.

This aim, these objects and others which will become apparent hereinafter are achieved by a multi-purpose appliance for household work comprising a wheeled body characterized in that it comprises, in combination in said body, steam generation means, means for generating a jet of air and aspiration means, said steam generation means, said air jet generation means and said aspiration means being connected to couplings for dispensing and aspiration ducts.

Advantageously, the appliance is equipped with a device for distributing gaseous and/or liquid fluids and for aspirating liquids, powders and solids, characterized in that it monolithically comprises quick couplings for simultaneously engaging a first duct for the conveyance of steam or hot water or detergent liquid, a second aspiration duct, and electric conductors, said ducts and said conductors being mutually separate.

BRIEF DESCRIPTION OF THE DRAWINGS

Further characteristics and advantages of the invention will become apparent from the detailed description of an embodiment thereof, illustrated only by way of nonlimitative example in the accompanying drawings, wherein.

DESCRIPTION OF THE PREFERRED EMBODIMENTS

Figures 1, 2:
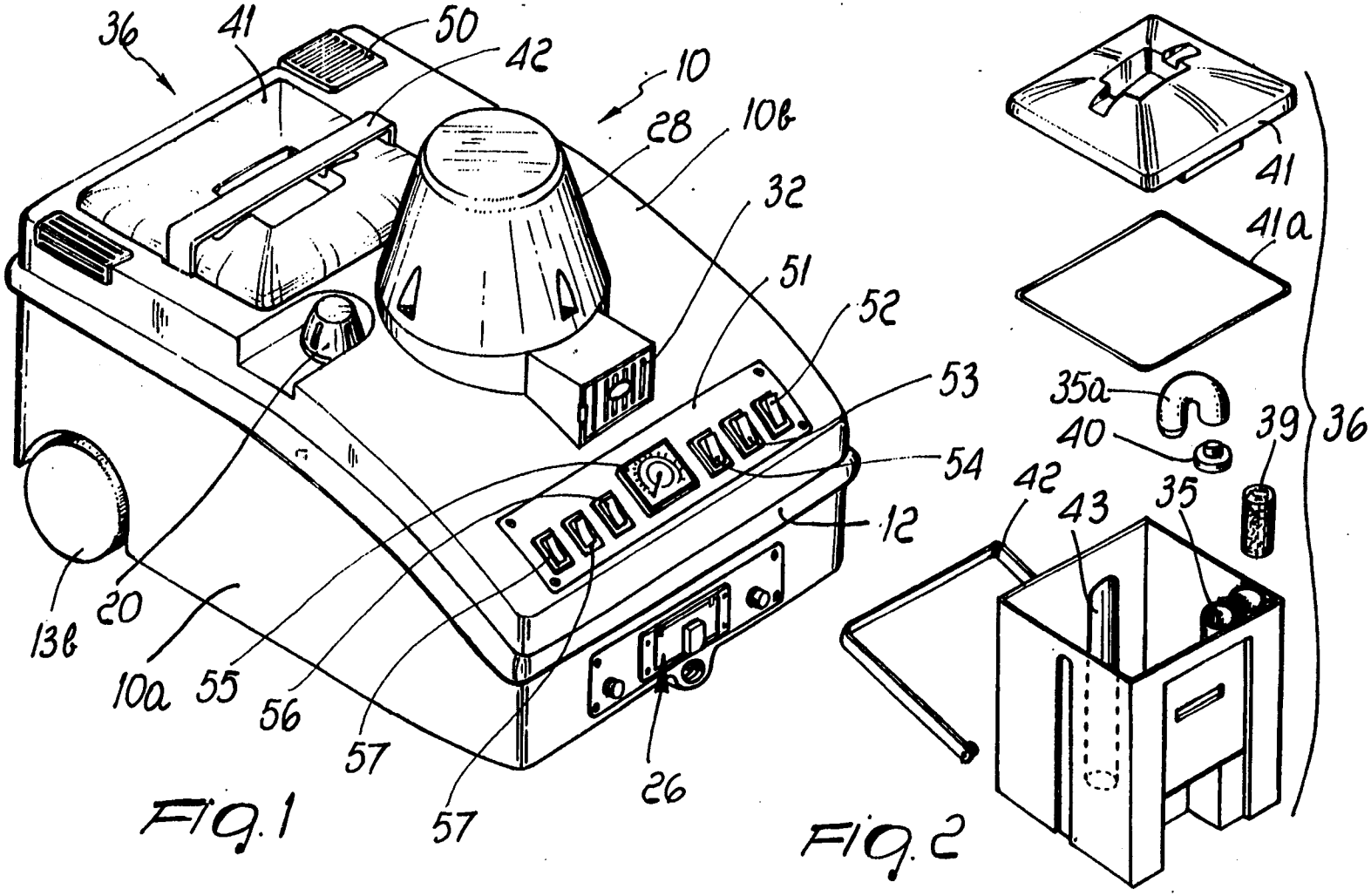
FIG. 1 is a perspective view of the appliance.
FIG. 2 is an exploded view of a waste collection tank comprised within the appliance of FIG. 1.
Figure 3:
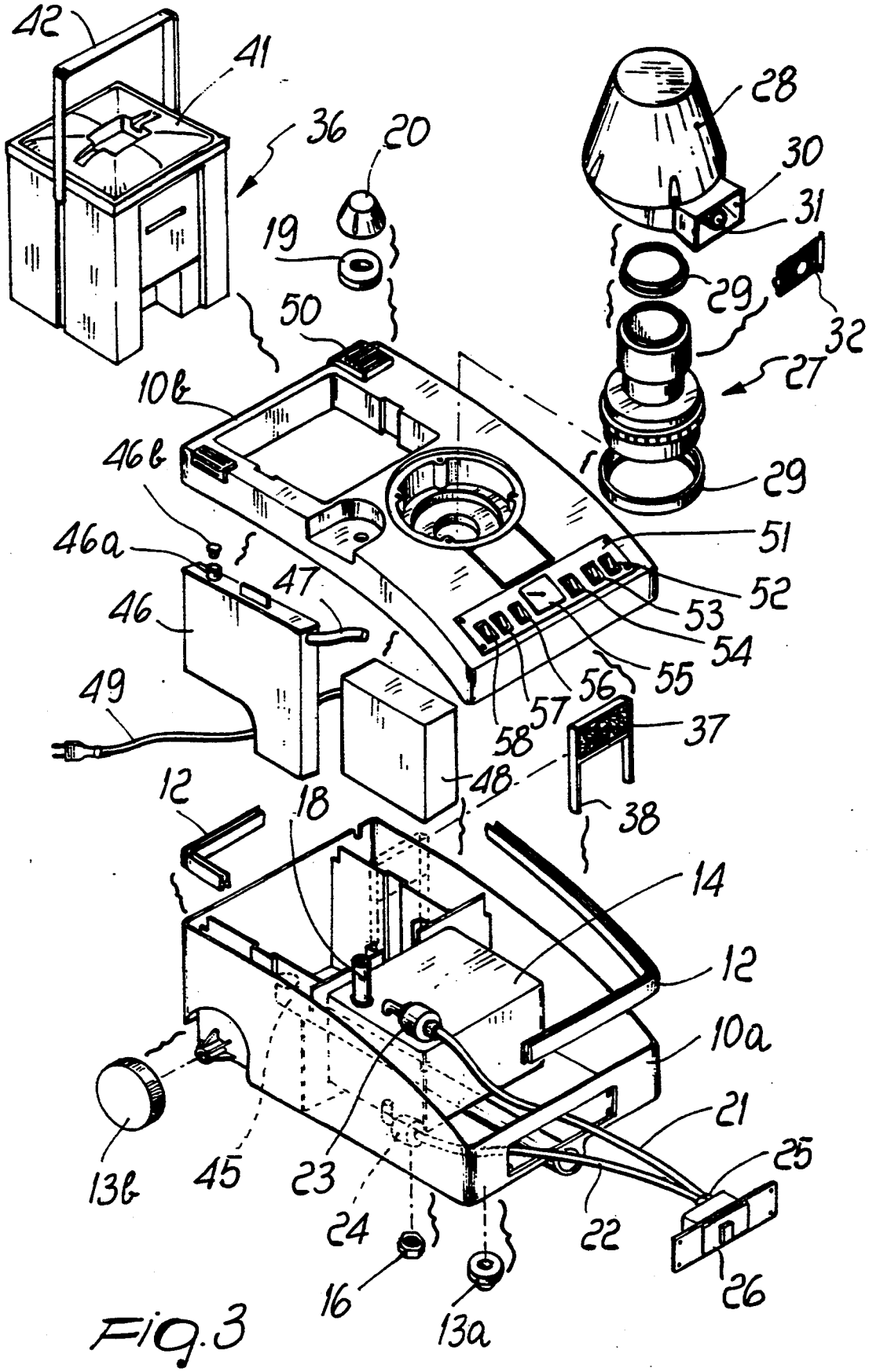
FIG. 3 is an exploded view of the appliance of figure 1.
Figure 4:
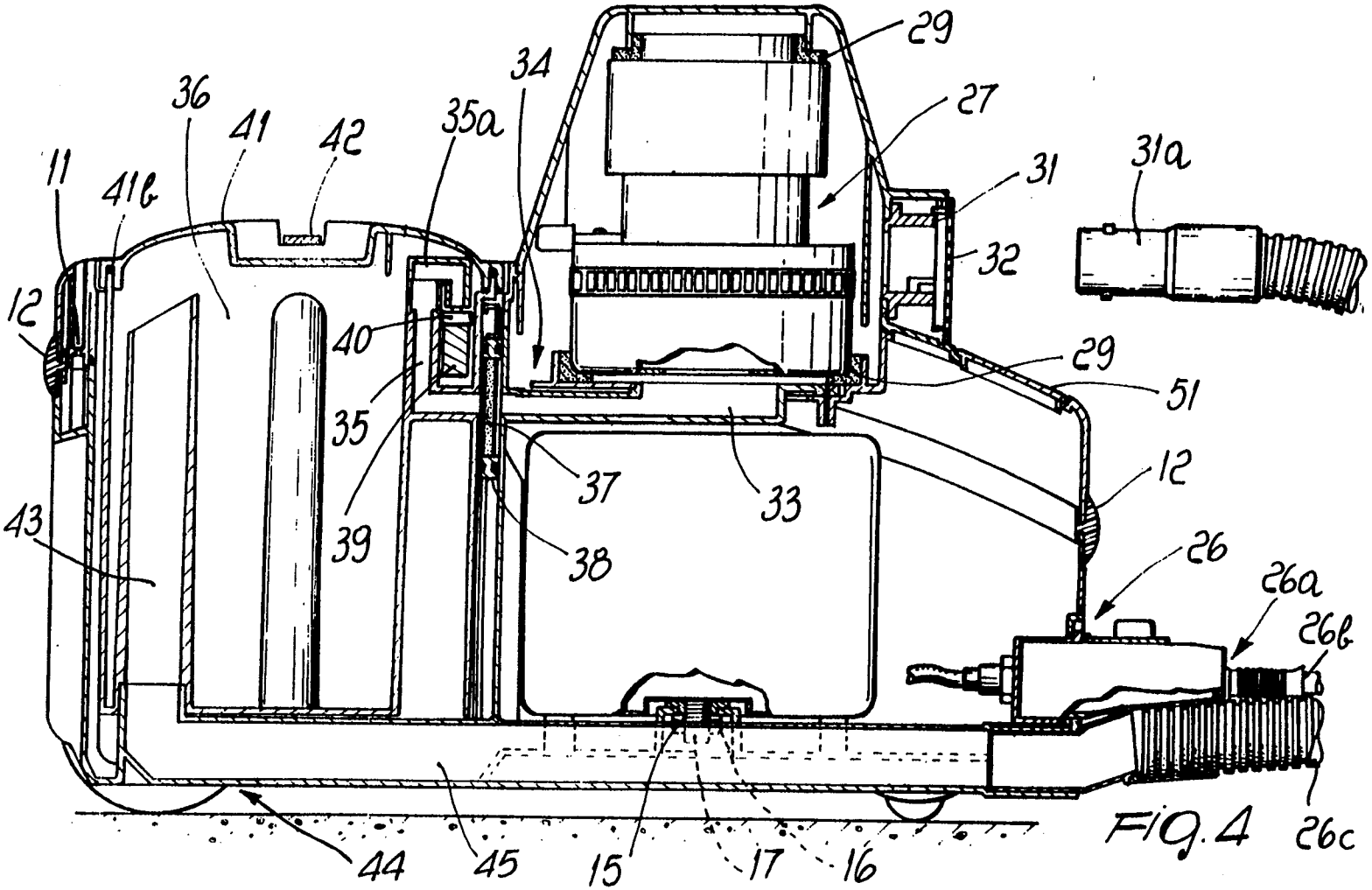
FIG. 4 is a schematic longitudinal sectional view of the appliance of FIG. 1, taken along a vertical plane.

With reference to the above FIGS. 1 to 4, a multipurpose appliance for household work comprises a box-like body, generally designated by the reference numeral 10, constituted by two elements **10*a* and 10*b* joined by means of screws 11 with the interposition of a perimetric shock-absorbing band 12** made of rubber.

The body 10 is conveniently provided with ground-resting wheels **13*a* and 13*b*** facilitating its transport where it is used.

According to the invention, inside the body 10 there are means for generating hot water and steam which are constituted by a boiler 14 located in the front lower part.

The boiler 14 is provided, in a downward region, with a tubular tang 15 inserted in an adapted hole of the body 10 and screwed by means of a fixing nut 16.

A plug 17 for emptying in case of cleaning engages on the tang 15.

In an upward region, the boiler 14 is provided with a tubular tang 18 on which a gasket 19 engages; the gasket is provided with a closure plug 20 for topping up with water.

An upper steam collection duct 21 and a lower hot water collection duct 22 end inside the boiler 14.

The ducts 21 and 22, each provided with a respective electric closure valve 23 and 24, end at appropriate levels inside the boiler 14 at one end and end in a single set 25 of female quick couplings, within a single frontally located body 26, for accommodating corresponding male quick couplings **26*a* in a single body of a steam/hot water dispensing duct 266, of an aspiration duct 26*c*** and of electrical connection cables, as more clearly described hereinafter.

Above said boiler 14, in said body 10 there is an electric motor-driven fan 27, which may optionally be provided with a power take-off on its head for auxiliary elements; the motor is enclosed by a lid 28 and arranged on rubber shock absorbers 29, and constitutes, means for generating a jet of air and a means for aspirating solids and liquids.

The lid 28 is provided, at the center of an opening 30 for the cooling air, with a tubular connector 31 for the coupling of a hose or air dispensing duct **31*a*** for the conveyance of the produced air jet.

The connector 31 is closed by a lid built into A grille 32 located on the opening 30.

By removing the grille 32 it is thus possible to gain access to the connector 31.

In a downward region, the motor driven fan 27 is connected to a first portion 33 of a first part 34 of an aspiration duct which ends with a second vertical portion 35 which has an upper open L-shaped bend **35*a* and is built into a waste container 36 accommodated in an adapted compartment of the body 10**.

A filter 37 is interposed between the two portions 33 and 35 and is accommodated in a frame-like support 38 conveniently located in an adapted region of the structure between the body 10 and the container 36.

A floater 39 can slide between the second vertical portion 35 of the first part 34 of the aspiration duct and the wall of the container 36, and is suitable to close the air passage between the container 36 and the duct 34 since it is suitable to abut, with a shutter 40 with which it is provided in an upward region, against the mouth of the L-shaped bend **35*a*** which opens downward.

The lid 41 is equipped with a gasket **41*a* for mating with the container 36**.

The floater 39 has the purpose of preventing the aspiration of liquid through the first part 34 of the aspiration duct when a safety level is exceeded.

The container 36 is provided with a retracting grip handle 42 allowing to extract it from the body 10 for emptying.

The container also includes a first upwardly open vertical portion 43 of a second part 44 of the aspiration duct, a second horizontal portion 45 of which is integrated in the lower part of the body 10 and ends in the frontally located monolithic couplings 26.

Mating between the portions 43 and 45 occurs by means of the insertion of one part of one into the other.

A detergent liquid tank 46 is accommodated to the side of the waste container 36 in the body 10 and is connected to the water and steam dispensing connector 25 by means of a duct 47. Liquid is fed from the container 36 to the connector 25 via the duct 47, by a Venturi effect created by providing a conventional Venturi assembly.

The tank 46 is equipped with a union **46*a* with a plug 46*b*** for topping up.

The appliance is completed by a cable winder 48 for an electric power supply cable 49, of a per se known type, actuatable by means of a button 50.

A control panel 51 is also provided on the front part of the body 10 and has a button 52 for activating a possible steam iron during steam-based operation, a steam dispensing button 53, a hot water dispensing button 54, a pressure switch 55 with a steam pressure indicator, a button 56 for activating the iron in dry-ironing mode and buttons 57 and 58 for starting the motor with two power levels.

With reference now to FIGS. 5 to 29, a distribution unit to be mated to the multi-purpose appliance comprises the monolithic male quick couplings **26*a* of a first steam conveyance duct 131 and of a second forced air aspiration duct 132 associatable with the female quick couplings 26**.

The flexible first and second ducts 131 and 132 are connected to a control handle 133 provided with means for controlling the devices of the appliance, generally designated by the reference numeral 130, and with a pair of unions for the connection to an end of a double spout 134 for steam distribution and forced aspiration, to another end of which it is possible to connect steam distribution and aspiration means.

The female quick couplings 26 comprise an upper coupling 135 for steam emission, at one side of which electric contacts 136 are arranged; said contacts are preferably female and are supplied by a power supply through electric cables 137 for a braid of electric conductors 138 enclosed in a sheath 155 contained in the first duct 131.

Preferably, the voltage present across the electric contacts 136, one of which is the ground, is 12 or 24 volts, depending on the applicable accident-prevention statutory provisions, in order to reduce the risk of accidents for the users of the appliance according to the present invention.

The female couplings 26 furthermore comprise a lower coupling 139 for the second duct 132.

An accommodation seat 140 for a locking pin 141 is provided between the upper coupling 135 and the lower coupling 139, as will become apparent hereinafter, and is delimited by a cross-member 143.

When the device according to the invention is not used, the upper coupling 135 can be covered by means of a door 142 articulated to the appliance 130.

The male quick couplings **26*a* monolithically comprise an upper container 144 into which the first duct 131, i.e. the sheath 155 and a steam duct 145**, leads.

The upper coupling 135 has a one-way steam valve provided with a sealing gasket which, when the steam duct 145 is inserted therein, pushes and spaces the closure gasket, allowing the flow of steam or liquids.

The electric conductors 138 are connected at said coupling to respective connecting pins, not shown, for connection to the electric contacts 136, and the steam duct 145 ends with an end 146 coupleable to the upper coupling 135 so as to form a seal ensured by an O-ring 147.

Lever systems for actuating the locking pin 141 and a lower union 147, constituting the end of the second duct 132, are provided in the container 144.

The lever systems comprise an actuation button 148 for the release of the pin 141 acting on an end of a lever 149 pivoted to the pin 150 which is rigidly coupled to the upper container 144.

The other end of the lever 149 engages the locking pin 141 protruding from the container 144 and, by means of an expansion 151, a cup-shaped element 152 wherein an end of a contrast spring 153 is fixed; the other end of said spring engages an internal wall of the container 144.

Figures 5, 6, 7, 8, 9:
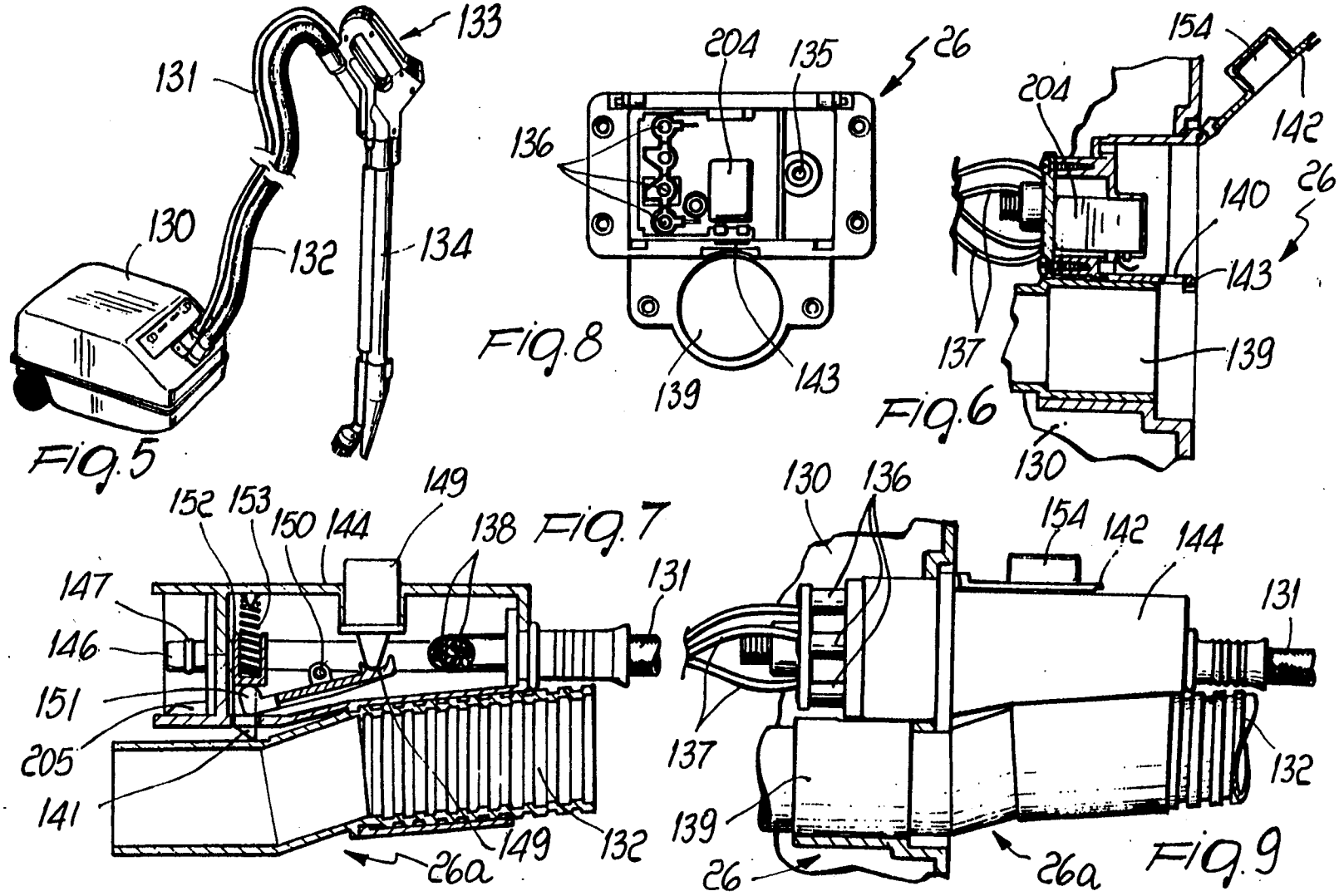
FIG. 5 is a perspective view of a distribution device according to the invention, applied to the appliance of FIG. 1.
FIG. 6 is a lateral sectional elevation view of female quick couplings.
FIG. 7 is a lateral sectional elevation view of male quick couplings.
FIG. 8 is a front elevation view of the female quick couplings.
FIG. 9 is a partially sectional side elevation view of the mating between the female quick couplings and the male quick couplings.

The spring 153 keeps the pin 141 in engagement position when the ducts 131 and 132 are coupled to the appliance 130. In order to protect the actuation button 148 against unwanted releases, the door 142 has a hollow protrusion 154 which, as shown in FIG. 9, covers the button when the ducts are coupled.

Figure 10:
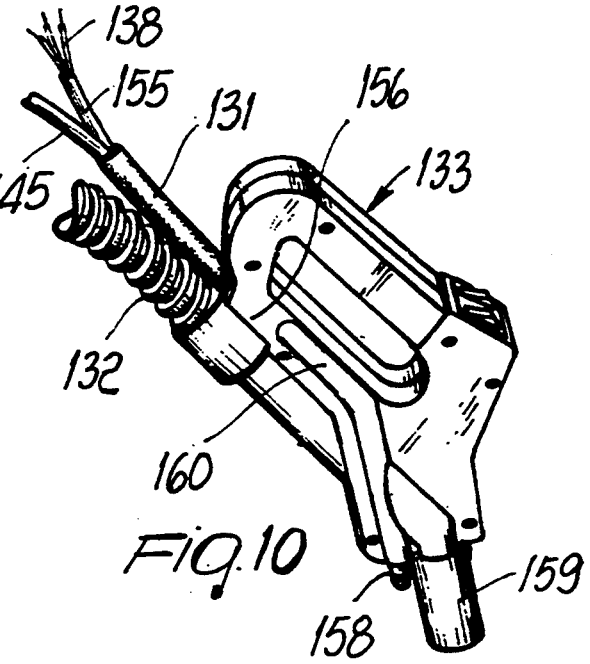
FIG. 10 is perspective view of a control handle.
Figure 11:
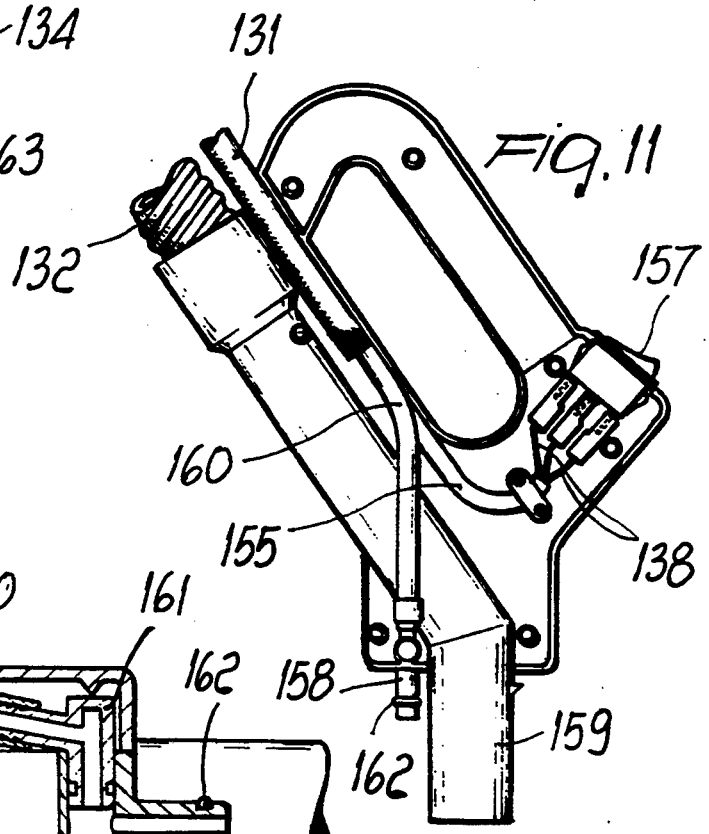
FIG. 11 is a partially sectional lateral elevation view of the handle.
Figure 12:
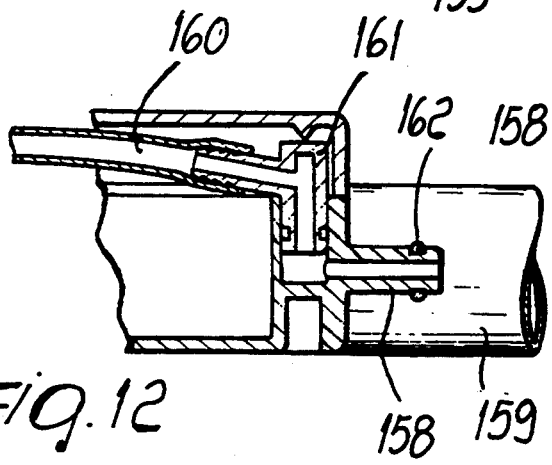
FIG. 12 is an enlarged sectional view of a detail of the handle.

The handle 133, FIGS. 10 to 12, comprises a region 156 where the sheath 155 and the duct 145 separate.

The electrical conductors 138 are connected to the control means constituted by control switches 157.

The steam duct 145 is connected to a curved element, as more clearly explained hereinafter, conveying its flow to a steam-tight dispenser 158 parallel to an aspiration inlet 159 for forced air, which is directly connected to the second duct 132.

The curved element comprises a first tube 160 directly connected to the duct 145 connected to a second transverse tube 161, leading into the dispenser 158, as more clearly shown in FIG. 12.

Tightness is ensured by an O-ring 162.

Figure 13:
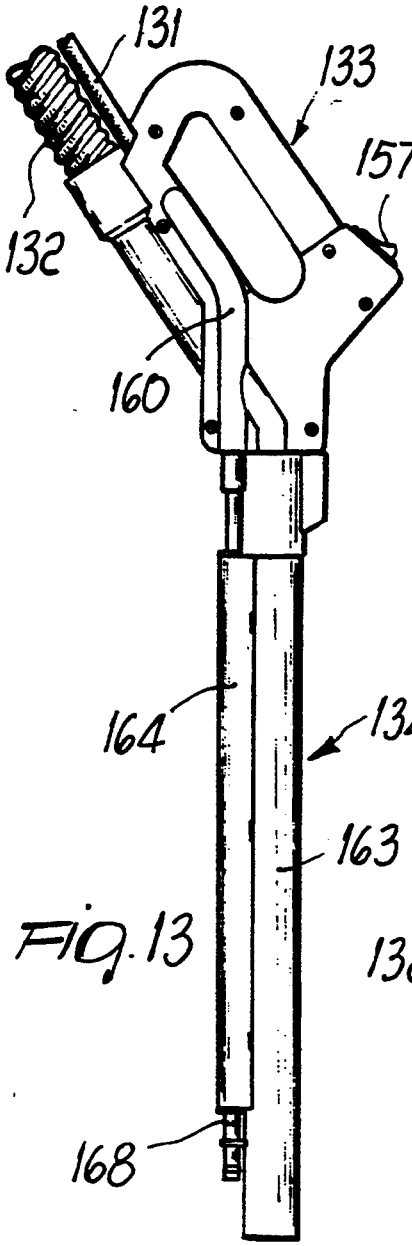
FIG. 13 is a lateral elevation view of a handle inserted in a double spout.
Figures 14, 15, 16, 17, 18, 19, 20:
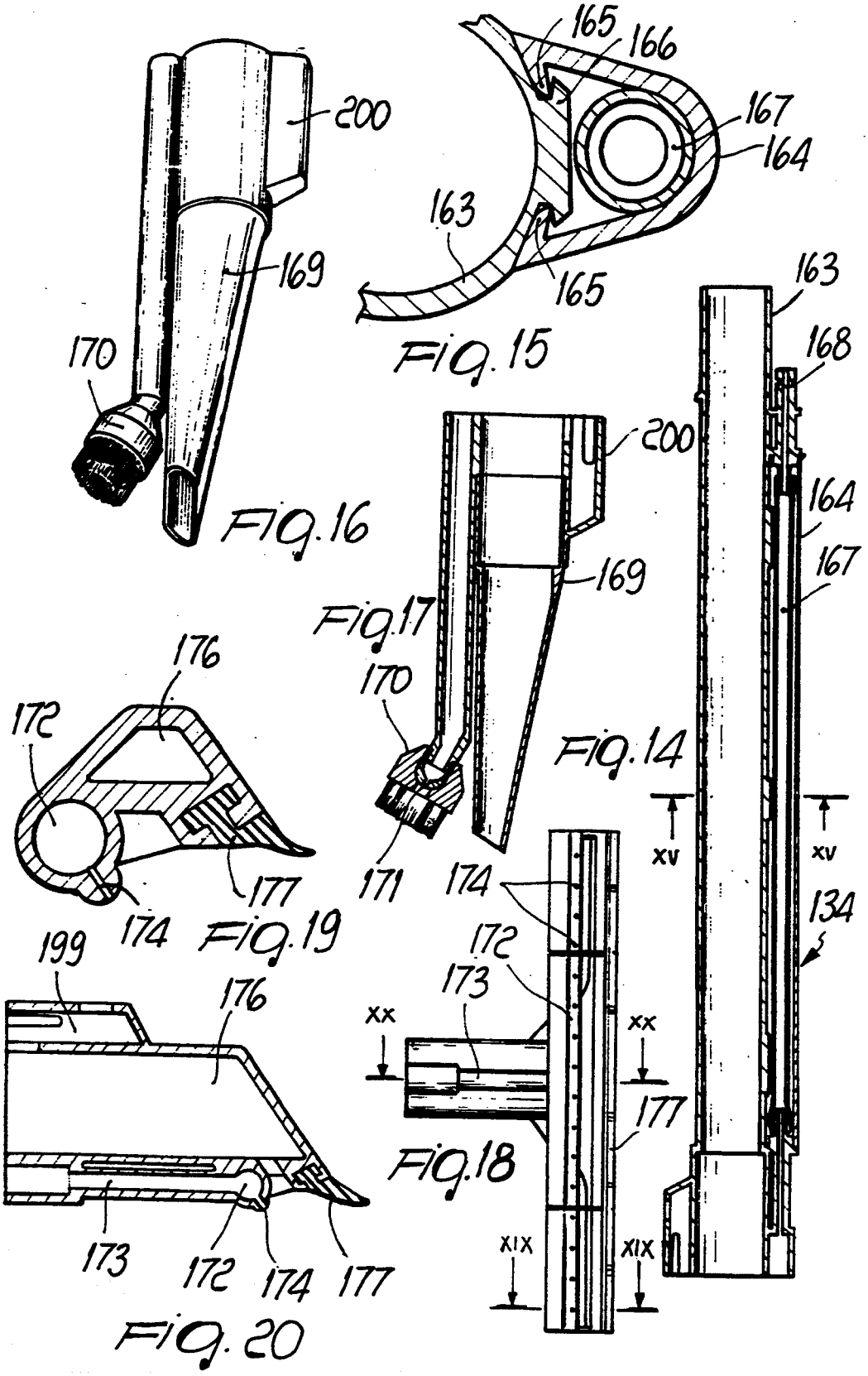
FIG. 14 is a sectional lateral elevation view of the double spout.
FIG. 15 is a sectional view, taken along the plane XV—XV of FIG. 14.
FIG. 16 is a perspective view of a first distribution-/aspiration unit.
FIG. 17 is a sectional lateral elevation view of the first distribution/aspiration unit.
FIG. 18 is a bottom plan view of a window pane cleaner.
FIG. 19 is a sectional view, taken along the plane XIX—XIX of FIG. 18.
FIG. 20 is a sectional view, taken along the plane XX—XX of FIG. 18.
Figure 21:
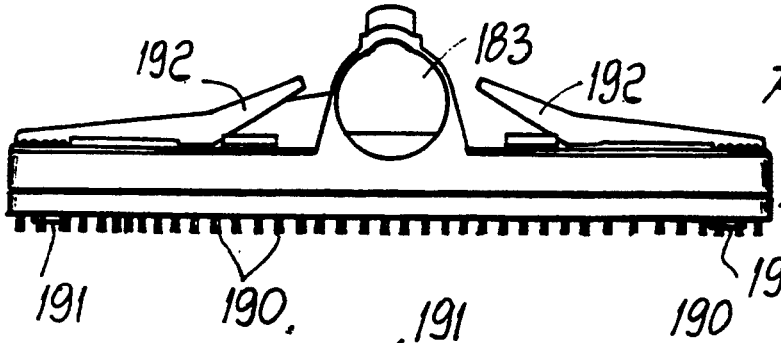
FIG. 21 is a front elevation view of a second distribution/aspiration unit.
Figure 22:
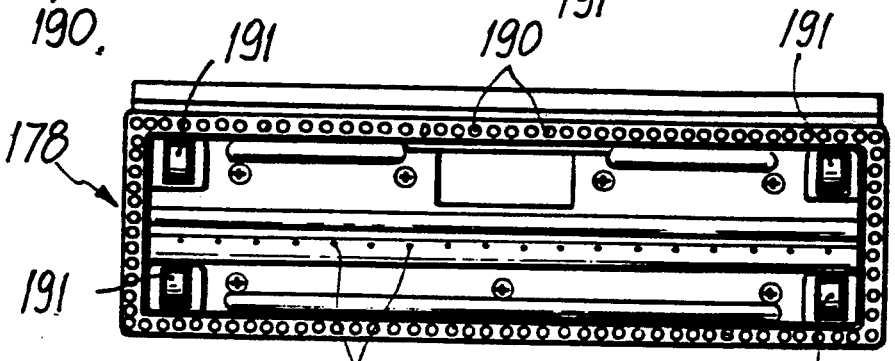
FIG. 22 is a bottom plan view of the second distribution/aspiration unit.
Figure 24:
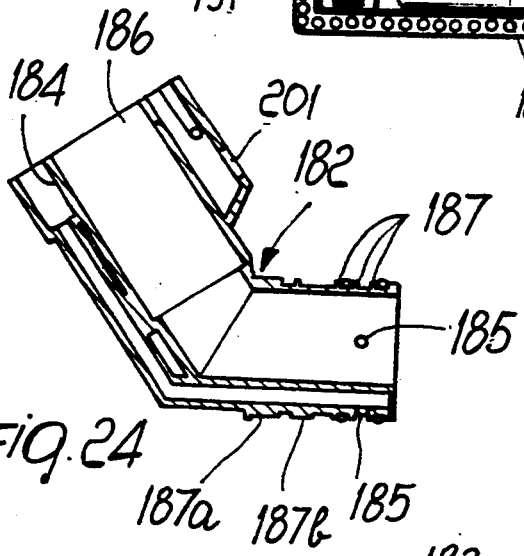
FIG. 24 is a sectional lateral elevation view of the connector.
Figure 23:
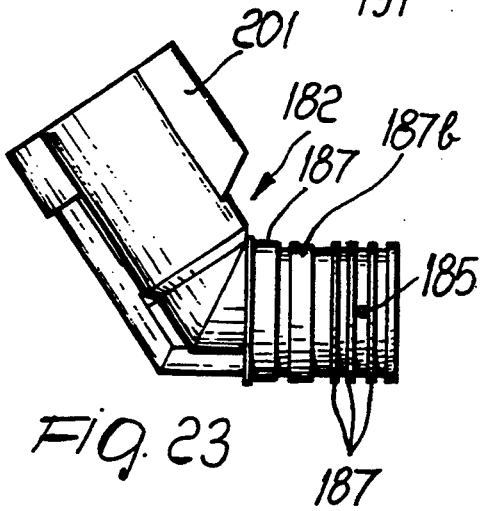
FIG. 23 is a lateral elevation view of a connector for connection between the double spout and the second distribution/aspiration unit.
Figure 25:
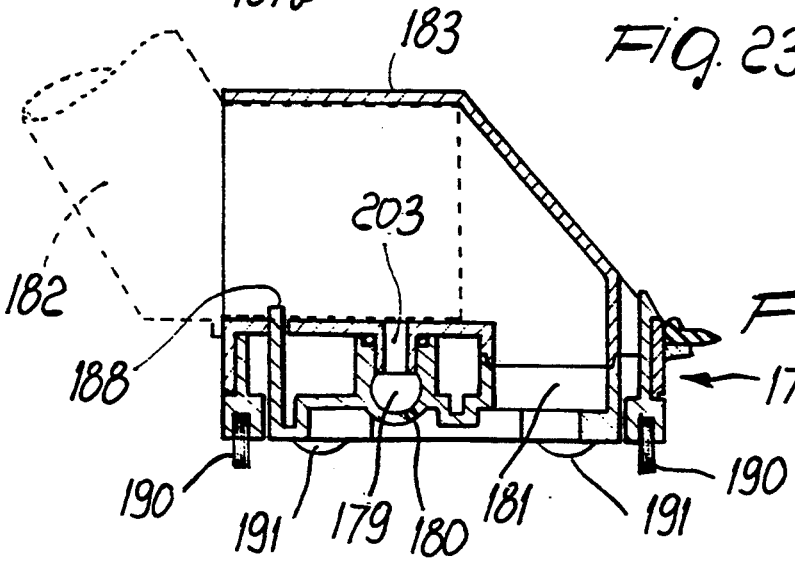
FIG. 25 is a sectional lateral elevation view of the second distribution/aspiration unit.
Figure 26:
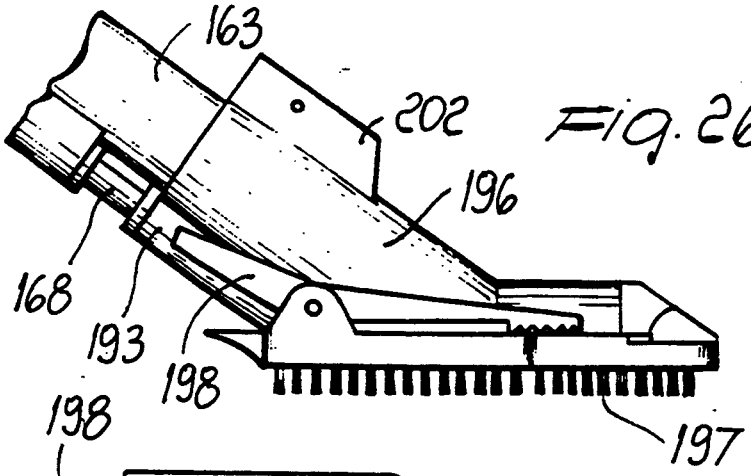
FIG. 26 is a lateral elevation view of a third distribution/aspiration unit.
Figure 27:
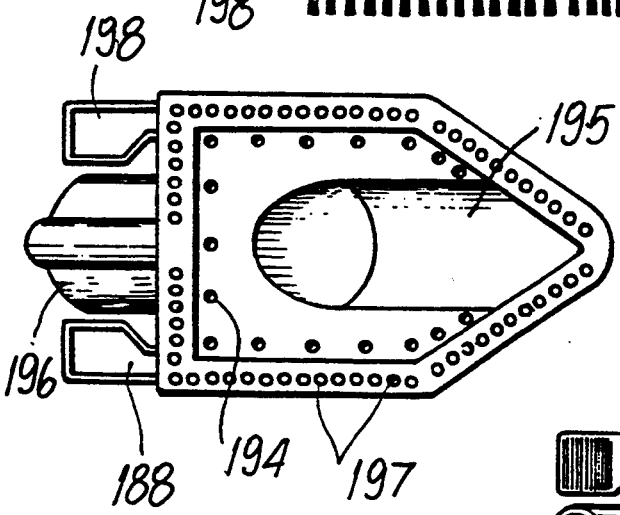
FIG. 27 is a bottom plan view of the third distribution/aspiration unit.
Figure 28:
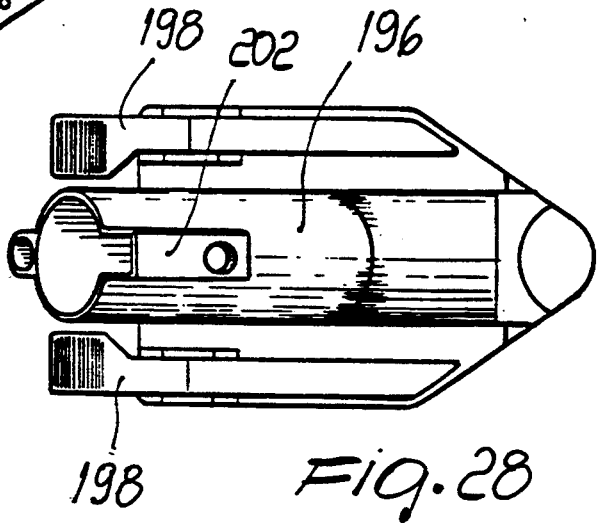
FIG. 28 is a plan view of the third distribution/aspiration unit.
Figure 29:
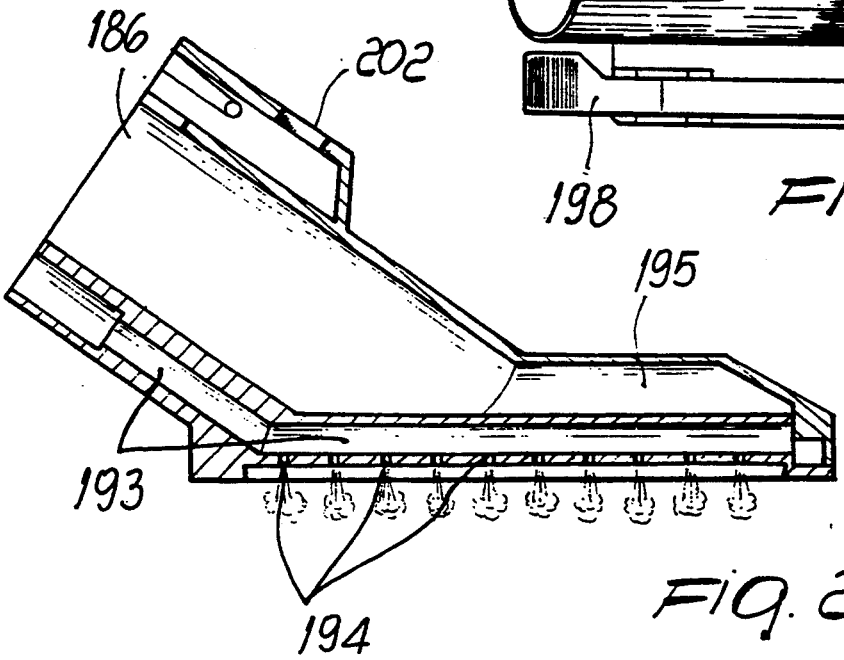
FIG. 29 is a sectional lateral elevation view of the third distribution/aspiration unit.

The double spout 134, FIGS. 13 to 15, comprises a forced aspiration duct 163 on the outer surface of which there is a steam distribution duct 167; the duct is enclosed in a duct guide 164 fixed to said duct 163 by means of longitudinal protrusions 165 engaging a dovetail ridge 166 protruding from said duct 163; the steam distribution duct 167 ends with a sealing connector 168 rigidly coupled to the duct 163, toward the steam distribution and aspiration means.

The ducts 163 and 167 are respectively connected to the dispenser 158 and to the aspiration inlet 159.

The distribution and aspiration means comprise various interchangeable tips according to the type of cleaning to be performed and according to the different working conditions.

A first distribution/aspiration unit, shown in FIGS. 16 and 17, comprises an aspiration inlet spout 169 connectable to the forced aspiration duct 163 and a steam emission brush 170 connectable to the sealing connector 168 of the duct 167. The inlet and the brush are included in a single assembly but are mutually unconnected.

The brush 170 has, in a central position, a steam emission nozzle 171.

A window-pane cleaner, FIGS. 18 to 20, comprises a transversely extended body 175 having a first transverse duct 172 which is connectable to the sealing connector 168 through a tube 173 and is provided with a plurality of steam emission nozzles 174, a second transverse aspiration duct 176 directly connectable to the forced aspiration duct 163 and a transverse lip 177 made of deformable plastic material for wiping the treated surface. A second distribution/aspiration unit, shown in FIGS. 21 to 26, has a plate-like element 178 provided, in an upward region, with a rotating elbow connector for connection to the sealed connector 168 and to the forced aspiration duct 163 and for distributing steam to a transverse emission duct 179 provided with a plurality of nozzles 180 for steam emission and aspiration from an aspiration inlet nozzle 181 arranged adjacent to the transverse duct 179 on the same lower face of the plate-like element 178.

The elbow connector comprises an angled connecting portion 182 and a distribution portion 183 rigidly coupled to the plate-like element 178.

The angled portion 182 comprises a duct 184 for connection to the sealing connector 168, which is provided with radial holes 185 for connection to a manifold 203 provided in the distribution portion 183 connected to the transverse emission duct 179, and an aspiration duct 186 directly connected to the aspiration inlet 181 through the distribution portion 183.

The outer surface of the angled portion 182 has a plurality of raised portions 187 which delimit means, such as sealing rings and the like, for providing a seal between the angled portion 182 and the distribution portion 183 which allow the rotation of the angled portion 182 with respect to the plate-like element.

Furthermore, a pair of protrusions 187*a* and 187*b* defines a guide 189 engaging on a pin 188 of the plate-like element 178 locking the angled portion within the distribution portion.

The plate-like element 178 is provided, on its lower face, with a plurality of bristle-like elements, gathered in circular groups 190, which are uniformly distributed along its perimeter, and with rollers 191 rotatably fixed at an angle to the lower face in order to facilitate the movement of the second distribution/aspiration unit.

Articulated engagement springs 192 for a cloth, not shown, which can be wrapped around the plate-like element 178, are provided on its upper face.

A third distribution/aspiration unit, shown in FIGS. 26 to 29, shaped like an iron, is provided with: a perimetric duct 193, which has a plurality of steam emission nozzles 194 and can be connected to the sealing connector 68; an aspiration inlet opening 195 arranged in a median position and connected to the aspiration duct 163 through a manifold 196; and a plurality of bristle-like elements, gathered in circular groups 197, arranged uniformly along the lower perimeter around the holes 194.

Articulated engagement springs 198 for a cloth, not shown, which can be wrapped around the third distribution/aspiration unit, are provided on its upper face.

A distribution unit, shown in FIGS. 30 to 33, whose body 206 has an equilateral triangular plan shape and is provided, in a downward region, with a plurality of groups 207 of bristle-like elements, is rotatably coupled at its central axis of symmetry, to the end 208 of a manifold 209 coupleable-onto the spout 134.

The end 208 is provided with three steam emission holes 210 inclined with respect to the axis and arranged at the same mutual angular distance.

Correspondingly, the lower surface of the body 206 has three channels 211 which are arranged at the same mutual angular distance and extend from a central region 212, surrounding the end 208, toward the corner regions.

The channels 211 are linked by regions 213 shaped so as to form deflectors for the jets of steam.

Figure 30:
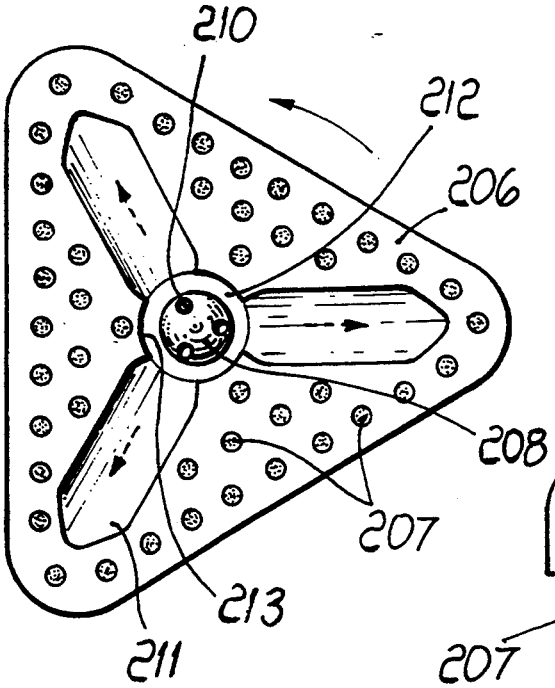
FIG. 30 is a sectional view of a distribution unit in a first operational embodiment.
Figure 31:
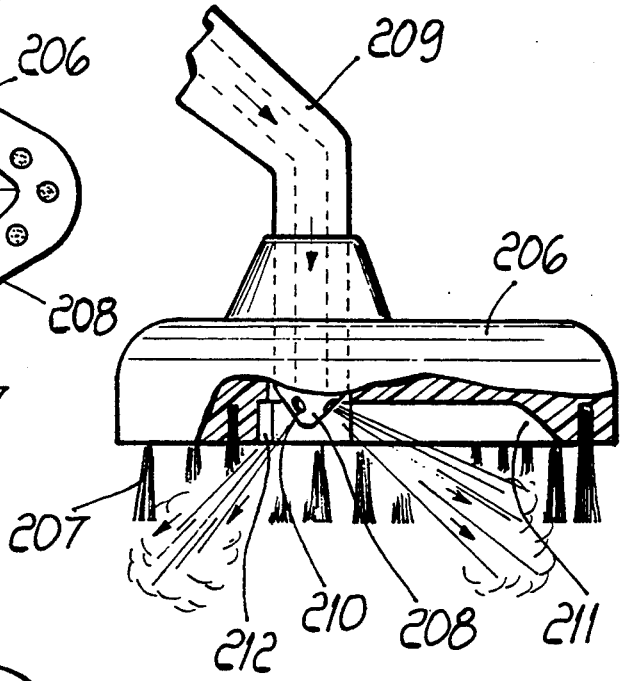
FIG. 31 is a bottom view of the distribution unit in the embodiment of FIG. 30.
Figure 32:
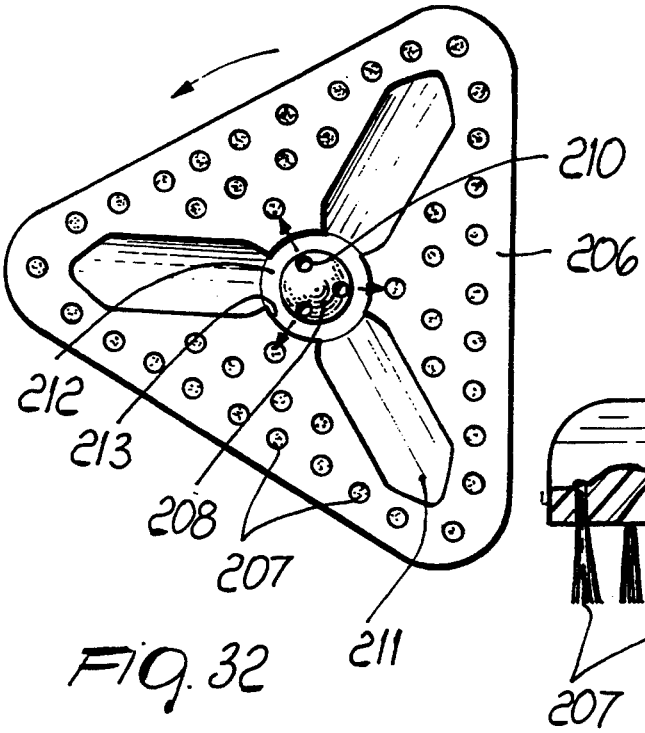
FIG. 32 is a sectional view of the distribution unit in a second operational embodiment.
Figure 33:
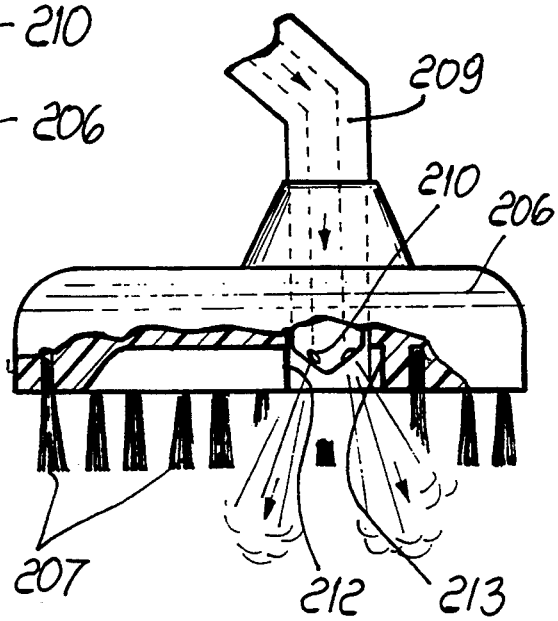
FIG. 33 is a bottom view of the distribution unit in the second embodiment.

Appropriate stop means, not shown, are suitable to keep the body 206 in the position shown in FIGS. 30 and 31 or in the position shown in FIGS. 32 and 33, i.e. with the holes 210 at the channels 211 or at the regions 213.

In the first case, the steam is distributed peripherally (so as to be able to work in corner regions as well), whereas in the second case it is distributed centrally.

The window-pane cleaner, the first, second and third distribution/aspiration units and the distribution unit furthermore have raised seats, respectively designated by the reference numerals 199, 200, 201 and 202, wherein an elastic pin, not shown, enters and engages; the pin is provided on the outer surface of the double spout 134.

Advantageously, it is also possible to provide microswitches arranged in the cavity 204, located adjacent to the electric contacts 136, which are closed by the insertion of cams 205 arranged on the male quick couplings 26*a* and are opened by their extraction, in order to have an electric power supply exclusively if the male quick couplings 26*a* are present in the respective female quick couplings 26, and thus in order to ensure a further accident-prevention protection.

At this point it should be stressed that the appliance is capable of acting as a small washdown machine with a jet of hot water at approximately 4 bar and 100° Celsius (to sterilize baths, for mechanical parts and miscellaneous sterilizations), as steam cleaning appliance with the addition or not of hot water or detergent liquid, injected into the steam duct due to a conventional Venturi effect and appropriately dosed, as boiler and power supply for an iron, as an aspirator for solids and liquids and as a generator of a jet of air for use as a small compressor for hydromassage.

In operation for irons, the pressure switch 55 supplies current only to the boiler 14 until it has reached the preset pressure.

Only after this point is current supplied to the resistor of the iron (although the associated button has been pressed).

In practice, the boiler and the iron are never on at the same time (and therefore their instantaneous consumptions are not added together) and it is possible to apply higher than usual power to them (e.g. 2200 W and 1000 W) without blowing the fuses of the household meter.

In some embodiments, the waste container 36 and the motor 27 may not be mounted on the body 10 and the appliance can operate only as floor-washer and washdown machine.

It is possible to store any accessories in the compartment instead of the container 36, which is appropriately closed by a lid.

It should also be stressed that the waste container 36 can be detached simply by extracting it from its compartment, differently from current appliances, in which it is necessary to remove a housing to extract the container.

It should also be stressed that the motor 27 is arranged in an elevated position with respect to the container 36 and to the boiler 14 and thus is not subject to the danger of water infiltrations in any case.

The distribution unit can advantageously operate as a pure vacuum cleaner, as a pure pressurized steam distributor (for the iron as well, which can be included in the accessories) and can also use both possibilities simultaneously, especially in the presence of particularly resistant dirt.

At this point the fact should be stressed that the connection between the various elements is performed by means of quick couplings, keeping the various ducts and conductors nonetheless separate.

The articulated connector allows, while keeping the ducts separate, to rotate the accessories through 360 degrees, allowing to work in any position.

The outlets of the ducts into the accessories are separate, but close together, and this allows to improve the operational result.

In practice it has been observed that the aim and objects of the present invention have been achieved.

The invention thus conceived is susceptible to numerous modifications and variations, all of which are within the scope of the inventive concept.

All the details may furthermore be replaced with other technically equivalent elements.

In practice, the materials employed, so long as they are compatible with the contingent use, as well as the dimensions, may be any according to the requirements.

I claim:

1. Multi-purpose appliance for household work comprising, a body (10) having a lower region, ground-resting wheels (13*a*, 13*b*) connected to said body (10), wherein said body (10) houses steam generation means (14, 21), means (27) for generating a jet of air, hot water generation means (14, 22) and aspiration means (27), said steam generation means (14, 21), said means (27) for generating a jet of air, said hot water generation means (14, 22) and said aspiration means (27) being connected to couplings (25–26*a*, 31) for dispensing ducts (31*a*, 26*b*) and aspiration ducts (26*c*), wherein said steam generation means (14) and said hot water generation means (14) comprise a boiler (14), arranged in said lower region of said body (10), an upper steam extraction duct (21) extending between said boiler and said couplings (25–26*a*), a lower hot water extraction duct (22) extending between said boiler (14) and said couplings (25–26*a*), and electric closure valves (23, 24) connected to said steam extraction duct (21) and to said hot water extraction duct (22).

2. Multi-purpose appliance according to claim 1, wherein said means (27) for generating a jet of air comprise an electric motor-driven fan (27), an opening (30) provided on said electric motor driven fan (27), said couplings (25–26*a*, 31) including a connector (31), said connector (31) being located in said opening (30), a grille (32) removably connected to said opening (30) for covering said connector (31), and an air dispensing duct (31*a*) connectable to said connector (30) upon removing said grille (32) from said opening (30).

3. Multi-purpose appliance according to claim 1, further comprising a first steam/hot water conveyance duct (145) and a forced air aspiration duct (132) connected to said couplings (25–26*a*), a control handle (133) having a steam/hot water dispenser duct (134, 158, 167, 168) connected to said steam/hot water conveyance duct (145), and an aspiration inlet (159, 163) connected to said forced air aspiration duct (132), and wherein said multi-purpose appliance further comprises a distribution/aspiration unit comprising;

a steam emission brush (170) releasably connected to said steam/hot water dispenser duct (134, 158, 167, 168);

a steam emission nozzle (171) located centrally on said steam emission brush (170), and;

an aspiration inlet spout (169) located adjacent said steam emission brush (170) and connected to said aspiration inlet (159, 163).

4. Multi-purpose appliance according to claim 1, further comprising a first steam/hot water conveyance duct (145) and a forced air aspiration duct (132) connected to said couplings (25–26*a*), a control handle (133) having a steam/hot water dispenser duct (134, 158, 167, 168) connected to said steam/hot water conveyance duct (145), and an aspiration inlet (159, 163) connected to said forced air aspiration duct (132), and wherein said multi-purpose appliance further comprises a window pane cleaner comprising;

a transversely extended body (175) defining therein a first transverse duct (172), said first transverse duct having a plurality of steam emission nozzles (174) and being connected to said steam/hot water dispenser duct (134, 158, 167, 168);

a second transverse aspiration nozzle (176) located adjacent said first transverse duct (172) and being connected to said aspiration inlet (159, 163), and;

a deformable transverse lip (177) connected to said window pane cleaner between said steam emission nozzles (174) and said aspiration nozzle (176).

5. Multi-purpose appliance according to claim 1, further comprising a first steam/hot water conveyance duct (145) and a forced air aspiration duct (132) connected to said couplings (25–26*a*), a control handle (133) having a steam/hot water dispenser duct (134, 158, 167, 168) connected to said steam/hot water conveyance duct (145), and an aspiration inlet (159, 163) connected to said forced air aspiration duct (132), and wherein said multi-purpose appliance further comprises a distribution/aspiration unit comprising;

a plate-like element (178) having affixed thereto a plurality of bristles (190);

a transverse emission duct (179) formed in said plate-like element (178) and connected to said steam/hot water dispenser duct (134, 158, 167, 168);

a plurality of steam emission nozzles (180) defined by said transverse emission duct (179) in said plate-like element (178), and;

an aspiration inlet nozzle (181) provided in said plate-like element (178) and connected to said aspiration inlet (159, 163).

6. Multi-purpose appliance according to claim 1, further comprising a first steam/hot water conveyance duct (145) and a forced air aspiration duct (132) connected to said couplings (25–26*a*), a control handle (133) having a steam/hot water dispenser duct (134, 158, 167, 168) connected to said steam/hot water conveyance duct (145), and an aspiration inlet (159, 163) connected to said forced air aspiration duct (132), and wherein said multi-purpose appliance further comprises a distribution/aspiration unit comprising an iron defining a perimetric duct (193) and an aspiration inlet opening (195), said perimetric duct (193) being connected to said steam/hot water dispenser duct (134, 158, 167, 168) and having formed therein a plurality of steam emission nozzles (194), said aspiration inlet opening (195) being connected to said aspiration inlet (159, 163) and surrounded by said steam emission nozzles (194).

7. Multi-purpose appliance according to claim 6, further comprising a pressure switch (55) for cutting off electrical power from said boiler (14) and supplying electrical heating power to said iron upon detecting a preset pressure within said boiler.

8. Multi-purpose appliance according to claim 1, further comprising a first steam/hot water conveyance duct (145) and a forced air aspiration duct (132) connected to said couplings (25–26*a*), a control handle (133) having a steam/hot water dispenser duct (134, 158, 167, 168) connected to said steam/hot water conveyance duct (145), and an aspiration inlet (159, 163) connected to said forced air aspiration duct (132), and wherein said multi-purpose appliance further comprises a distribution/aspiration unit comprising;

a manifold (209) connected to said steam/hot water dispenser duct (134, 158, 167, 168) and having an end (208), said end (208) having formed therein steam emission holes (210);

a shaped body (206) connected to said end (108) of said manifold (209) and having formed thereon a plurality of channels (211);

wherein said shaped body (206) is rotatable with respect to said manifold (209) for selectively moving said channels (211) into and out of alignment with said steam emission holes (210).

9. Multi-purpose appliance for household work comprising, a body (10) having a lower region, ground-resting wheels (13*a*, 13*b*) connected to said body (10), wherein said body (10) houses steam generation means (14, 21), means (27) for generating a jet of air, hot water generation means (14, 22) and aspiration means (27), said steam generation means (14, 21), said means (27) for generating a jet of air, said hot water generation means (14, 22) and said aspiration means (27) being connected to couplings (25–26*a*, 31) for dispensing ducts (31*a*, 26*b*) and aspiration ducts (26*c*), wherein said means (27) for generating a jet of air comprise an electric motor-driven fan (27), an opening (30) provided on said electric motor driven fan (27), said couplings (25–26*a*, 31) including a connector (31), said connector (31) being located in said opening (30), a grille (32) removably connected to said opening (30) for covering said connector (31), and an air dispensing duct (31*a*) connectable to said connector (30) upon removing said grille (32) from said opening (30).

10. Multi-purpose appliance according to claim 9, further comprising a first steam/hot water conveyance duct (145) and a forced air aspiration duct (132) connected to said couplings (25–26*a*), a control handle (133) having a steam/hot water dispenser duct (134, 158, 167, 168) connected to said steam/hot water conveyance duct (145), and an aspiration inlet (159, 163) connected to said forced air aspiration duct (132), and wherein said multi-purpose appliance further comprises a distribution/aspiration unit comprising;

a steam emission brush (170) releasably connected to said steam/hot water dispenser duct (134, 158, 167, 168);

a steam emission nozzle (171) located centrally on said steam emission brush (170), and;

an aspiration inlet spout (169) located adjacent said steam emission brush (170) and connected to said aspiration inlet (159, 163).

11. Multi-purpose appliance according to claim 9, further comprising a first steam/hot water conveyance duct (145) and a forced air aspiration duct (132) connected to said couplings (25–26*a*), a control handle (133) having a steam/hot water dispenser duct (134, 158, 167, 168) connected to said steam/hot water conveyance duct (145), and an aspiration inlet (159, 163) connected to said forced air aspiration duct (132), and wherein said multi-purpose appliance further comprises a window pane cleaner comprising;

a transversely extended body (175) defining therein a first transverse duct (172), said first transverse duct having a plurality of steam emission nozzles (174) and being connected to said steam/hot water dispenser duct (134, 158, 167, 168);

a second transverse aspiration nozzle (176) located adjacent said first transverse duct (172) and being connected to said aspiration inlet (159, 163), and;

deformable transverse lip (177) connected to said window pane cleaner between said steam emission nozzles (174) and said aspiration nozzle (176).

12. Multi-purpose appliance according to claim 9, further comprising a first steam/hot water conveyance duct (145) and a forced air aspiration duct (132) connected to said couplings (25–26*a*), a control handle (133) having a steam/hot water dispenser duct (134, 158, 167, 168) connected to said steam/hot water conveyance duct (145), and an aspiration inlet (159, 163) connected to said forced air aspiration duct (132), and wherein said multi-purpose appliance further comprises a distribution/aspiration unit comprising;

a plate-like element (178) having affixed thereto a plurality of bristles (190);

a transverse emission duct (179) formed in said plate-like element (178) and connected to said steam/hot water dispenser duct (134, 158, 167, 168);

a plurality of steam emission nozzles (180) defined by said transverse emission duct (179) in said plate-like element (178), and;

an aspiration inlet nozzle (181) provided in said plate-like element (178) and connected to said aspiration inlet (159, 163).

13. Multi-purpose appliance according to claim 9, further comprising a first steam/hot water conveyance duct (145) and a forced air aspiration duct (132) connected to said couplings (25–26*a*), a control handle (133) having a steam/hot water dispenser duct (134, 158, 167, 168) connected to said steam/hot water conveyance duct (145), and an aspiration inlet (159, 163) connected to said forced air aspiration duct (132), and wherein said multi-purpose appliance further comprises a distribution/aspiration unit comprising an iron defining a perimetric duct (193) and an aspiration inlet opening (195), said perimetric duct (193) being connected to said steam/hot water dispenser duct (134, 158, 167, 168) and having formed therein a plurality of steam emission nozzles (194), said aspiration inlet opening (195) being connected to said aspiration inlet (159, 163) and surrounded by said steam emission nozzles (194).

14. Multi-purpose appliance according to claim 13, further comprising a pressure switch (55) for cutting off electrical power from said boiler (14) and supplying electrical heating power to said iron upon detecting a preset pressure within said boiler.

15. Multi-purpose appliance according to claim 9, further comprising a first steam/hot water conveyance duct (145) and a forced air aspiration duct (132) connected to said couplings (25–26*a*), a control handle (133) having a steam/hot water dispenser duct (134, 158, 167, 168) connected to said steam/hot water conveyance duct (145), and an aspiration inlet (159, 163) connected to said forced air aspiration duct (132), and wherein said multi-purpose appliance further comprises a distribution/aspiration unit comprising;

a manifold (209) connected to said steam/hot water dispenser duct (134, 158, 167, 168) and having an end (208), said end (208) having formed therein steam emission holes (210);

a shaped body (206) connected to said end (108) of said manifold (209) and having formed thereon a plurality of channels (211);

wherein said shaped body (206) is rotatable with respect to said manifold (209) for selectively moving said channels (211) into and out of alignment with said steam emission holes (210).

16. Multi-purpose appliance for household work comprising, a body (10) housing steam generation means (14, 21), means (27) for generating a jet of air, hot water generation means (14, 22) and aspiration means (27), said steam generation means (14, 21), said hot water generation means (14, 22) and said aspiration means (27) being connected to couplings (25–26*a*) for dispensing ducts (31*a*, 26*b*) and aspiration ducts (26*c*), said means (27) for generating a jet of air being connected to an air dispensing duct (31*a*), wherein said steam generation means (14) and said hot water generation means (14) comprise a boiler (14), a steam extraction duct (21) extending between said boiler and said couplings (25–26*a*), a hot water extraction duct (22) extending between said boiler (14) and said couplings (25–26*a*), and electric closure valves (23, 24) connected to said steam extraction duct (21) and to said hot water extraction duct (22).

17. Multi-purpose appliance according to claim 16, further comprising a first steam/hot water conveyance duct (145) and a forced air aspiration duct (132) connected to said couplings (25–26*a*), a control handle (133) having a steam/hot water dispenser duct (134, 158, 167, 168) connected to said steam/hot water conveyance duct (145), and an aspiration inlet (159, 163) connected to said forced air aspiration duct (132), and wherein said multi-purpose appliance further comprises a distribution/aspiration unit comprising;

a steam emission brush (170) releasably connected to said steam/hot water dispenser duct (134, 158, 167, 168);

a steam emission nozzle (171) located centrally on said steam emission brush (170), and;

an aspiration inlet spout (169) located adjacent said steam emission brush (170) and connected to said aspiration inlet (159, 163).

18. Multi-purpose appliance according to claim 16, further comprising a first steam/hot water conveyance duct (145) and a forced air aspiration duct (132) connected to said couplings (25–26*a*), a control handle (133) having a steam/hot water dispenser duct (134, 158, 167, 168) connected to said steam/hot water conveyance duct (145), and an aspiration inlet (159, 163) connected to said forced air aspiration duct (132), and wherein said multi-purpose appliance further comprises a window pane cleaner comprising;

a transversely extended body (175) defining therein a first transverse duct (172), said first transverse duct having a plurality of steam emission nozzles (174) and being connected to said steam/hot water dispenser duct (134, 158, 167, 168;

a second transverse aspiration nozzle (176) located adjacent said first transverse duct (172) and being connected to said aspiration inlet (159, 163), and;

a deformable transverse lip (177) connected to said window pane cleaner between said steam emission nozzles (174) and said aspiration nozzle (176).

19. Multi-purpose appliance according to claim 16, further comprising a first steam/hot water conveyance duct (145) and a forced air aspiration duct (132) connected to said couplings (25–26*a*), a control handle (133) having a steam/hot water dispenser duct (134, 158, 167, 168) connected to said steam/hot water conveyance duct (145), and an aspiration inlet (159, 163) connected to said forced air aspiration duct (132), and wherein said multi-purpose appliance further comprises a distribution/aspiration unit comprising;

a plate-like element (178) having affixed thereto a plurality of bristles (190);

a transverse emission duct (179) formed in said plate-like element (178) and connected to said steam/hot water dispenser duct (134, 158, 167, 168);

a plurality of steam emission nozzles (180) defined by said transverse emission duct (179) in said plate-like element (178), and;

an aspiration inlet nozzle (181) provided in said plate-like element (178) and connected to said aspiration inlet (159, 163).

20. Multi-purpose appliance according to claim 16, further comprising a first steam/hot water conveyance duct (145) and a forced air aspiration duct (132) connected to said couplings (25–26*a*), a control handle (133) having a steam/hot water dispenser duct (134, 158, 167, 168) connected to said steam/hot water conveyance duct (145), and an aspiration inlet (159, 163) connected to said forced air aspiration duct (132), and wherein said multi-purpose appliance further comprises a distribution/aspiration unit comprising;

an iron defining a perimetric duct (193) and an aspiration inlet opening (195), said perimetric duct (193) being connected to said steam/hot water dispenser duct (134, 158, 167, 168) and having formed therein a plurality of steam emission nozzles (194), said aspiration inlet opening (195) being connected to said aspiration inlet (159, 163) and surrounded by said steam emission nozzles (194).

21. Multi-purpose appliance according to claim 20, further comprising a pressure switch (55) for cutting off electrical power from said boiler (14) and supplying electrical heating power to said iron upon detecting a preset pressure within said boiler.

22. Multi-purpose appliance according to claim 1, further comprising a first steam/hot water conveyance duct (145) and a forced air aspiration duct (132) connected to said couplings (25–26*a*), a control handle (133) having a steam/hot water dispenser duct (134, 158, 167, 168) connected to said steam/hot water conveyance duct (145), and an aspiration inlet (159, 163) connected to said forced air aspiration duct (132), and wherein said multi-purpose appliance further comprises a distribution/aspiration unit comprising;

a manifold (209) connected to said steam/hot water dispenser duct (134, 158, 167, 168) and having an end (208), said end (208) having formed therein steam emission holes (210);

a shaped body (206) connected to said end (108) of said manifold (209) and having formed thereon a plurality of channels (211);

wherein said shaped body (206) is rotatable with respect to said manifold (209) for selectively moving said channels (211) into and out of alignment with said steam emission holes (210).

* * * * *